US008335452B2

(12) United States Patent
Muramoto et al.

(10) Patent No.: US 8,335,452 B2
(45) Date of Patent: Dec. 18, 2012

(54) IMAGE FORMING APPARATUS

(75) Inventors: Kouki Muramoto, Toyohashi (JP); Hideyuki Nukumi, Ama-gun (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 364 days.

(21) Appl. No.: 12/822,334

(22) Filed: Jun. 24, 2010

(65) Prior Publication Data

US 2010/0327718 A1 Dec. 30, 2010

(30) Foreign Application Priority Data

Jun. 30, 2009 (JP) ..... 2009-155374

(51) Int. Cl.
*G03G 15/00* (2006.01)

(52) U.S. Cl. ..... 399/107

(58) Field of Classification Search ..... 399/107, 399/110

See application file for complete search history.

(56) References Cited

U.S. PATENT DOCUMENTS

| | | | | |
|---|---|---|---|---|
| 7,551,873 | B2 * | 6/2009 | Hiura | 399/107 |
| 2002/0064393 | A1 * | 5/2002 | Akimoto | 399/107 |
| 2007/0077085 | A1 * | 4/2007 | Kitamura et al. | 399/110 |
| 2007/0147882 | A1 * | 6/2007 | Igarashi | 399/110 |
| 2008/0260441 | A1 * | 10/2008 | Takagi et al. | 399/360 |

FOREIGN PATENT DOCUMENTS

| | | | |
|---|---|---|---|
| JP | 35-011707 | | 12/1956 |
| JP | 52-160754 | | 12/1977 |
| JP | 55-027787 | | 2/1980 |
| JP | 57-042069 | | 3/1982 |
| JP | 01-085737 | | 6/1989 |
| JP | 7-219286 | A | 8/1995 |
| JP | 10-149077 | | 6/1998 |
| JP | 11-158921 | | 6/1999 |
| JP | 2002-148881 | A | 5/2002 |
| JP | 2005-138967 | A | 6/2005 |
| JP | 2006-030219 | | 2/2006 |

OTHER PUBLICATIONS

Office Action (Notification of Reasons for Refusal) dated Apr. 26, 2011, issued in the corresponding Japanese Patent Application No. 2009-155374, and an English Translation thereof.

* cited by examiner

*Primary Examiner* — Walter L Lindsay, Jr.
*Assistant Examiner* — Rodney Bonnette
(74) *Attorney, Agent, or Firm* — Buchanan Ingersoll & Rooney PC

(57) ABSTRACT

An image forming apparatus having a door on a side surface of a body of the apparatus. Three pivot points for supporting the door to be capable of pivoting horizontally are disposed in the rear side of the apparatus body, in an upper section, in a middle section and in a lower section, respectively. The upper pivot point and the lower pivot point are adjustable with reference to the middle pivot point.

5 Claims, 4 Drawing Sheets

IMAGE FORMING APPARATUS

This application is based on Japanese Patent Application No. 2009-155374 filed on Jun. 30, 2009, the content of which is incorporated herein by reference.

BACKGROUND OF THE INVENTION

1. Field of the Invention

The present invention relates to an image forming apparatus, and more particularly to an image forming apparatus having a door on a side surface of an apparatus body.

2. Description of Related Art

An electrophotographic image forming apparatus, for example, a coping machine or a printer has a feed section in a lower part of an apparatus body, and a (vertical) sheet path (and a sheet reversing path for double-side printing, if necessary) or a manual feed section in a side part of the apparatus body. There are many prior art documents that disclose this kind of image forming apparatuses, and Japanese Patent Laid-Open Publication No. 7-219286, Japanese Patent Laid-Open Publication No. 2002-148881 and Japanese Patent Laid-Open Publication No. 2005-138967 are typical examples of these prior art documents.

When such an image forming apparatus has a plurality of doors that incorporate various components of sheet paths, the apparatus has the following disadvantages: a large number of positioning mechanisms for positioning the respective doors relative to the apparatus body are necessary; it is likely that the components of the sheet paths may be out of alignment, which causes sheet skew and sheet displacement and which lowers the sheet feeding performance, resulting in degradation of the picture quality; and a user is required to do many things to treat a paper jam.

Meanwhile, it is possible to provide only one door, not a plurality of doors, on a side surface of the apparatus body. However, when the door is too large, the door is likely to be deformed, and it is necessary to provide a lock mechanism for securing the door closed. In this case, further, misdetection of the open/closed state of the door may occur, and it is necessary to provide a mechanism for closing the door without fail.

SUMMARY OF THE INVENTION

An object of the present invention is to provide an image forming apparatus that has a door in an accurate position on a side surface of the apparatus body so as to achieve a high sheet feeding performance and to facilitate treatment of a paper jam.

According to an aspect of the present invention, an image forming apparatus comprises: a door provided on a side surface of a body of the image forming apparatus; and three pivot points for supporting the door to be capable of pivoting horizontally, the pivot points being disposed in a rear side of the body of the image forming apparatus, in an upper section, in a middle section and in a lower section, respectively. The pivot points in the upper section and in the lower section are adjustable with reference to the pivot point in the middle section.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Figure 1:
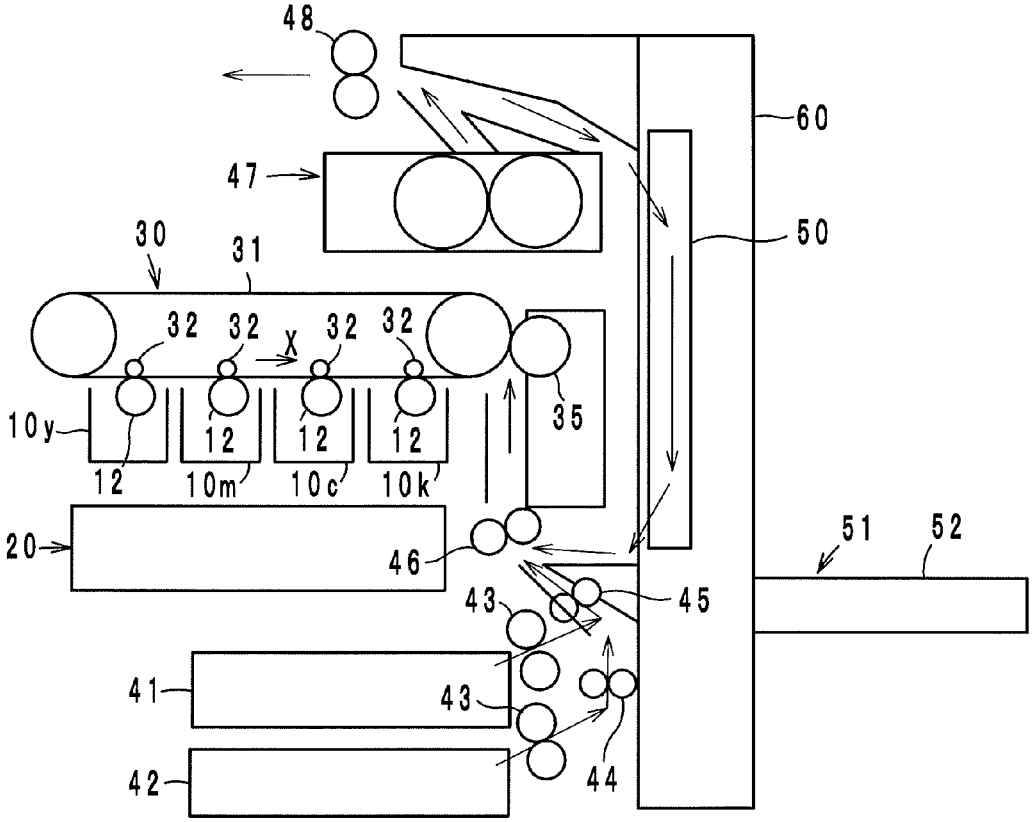
FIG. 1 is a schematic view of a printer that is an image forming apparatus according to an embodiment of the present invention.

Preferred embodiments of an image forming apparatus according to the present invention will be described with reference to the accompanying drawings. In the drawings, the same parts and the same members are provided with the same reference symbols, and descriptions thereof are not repeated.

General Structure of the Image Forming Apparatus

An image forming apparatus according to an embodiment of the present invention is described with reference to FIG. 1. The image forming apparatus is a tandem type color printer, which generally comprises process units 10 (10*y*, 10*m*, 10*c* and 10*k*) for forming toner images of yellow, magenta, cyan and black respectively, a laser scanning unit 20 and an intermediate transfer unit 30.

Each of the process units 10 comprises, in a housing, a photosensitive drum 12, a charging roller, a developing device, a cleaner for cleaning residual toner and residual charge and other members (not shown). The process units 10 are attachable to and detachable from the body of the image forming apparatus in a direction perpendicular to the paper surface of FIG. 1. In each of the process units 10, an electrostatic latent image is written on the photosensitive drum 12 by laser radiation from the laser scanning unit 20, and the electrostatic latent image is developed into a toner image.

The intermediate transfer unit 30 comprises an intermediate transfer belt 31 that is an endless belt driven to rotate in a direction "X". Transfer rollers 32 are disposed in positions to face the respective photosensitive drums 12, and thereby, electric fields are caused. Toner images formed on the photosensitive drums 12 are transferred onto the intermediate transfer belt 31 by the electric fields and are combined thereon (first transfer). Such an electrophotographic image forming process is well known, and a detailed description thereof is omitted.

In a lower part of the apparatus body, a first feed unit 41 and a second feed unit 42 are disposed, and recording sheets are fed from the feed units 41 and 42 one by one. A recording sheet is fed out from the feed unit 41 or 42 by a pair of feed-out rollers 43 and fed forward by pairs of rollers 44 and 45 to a pair of timing rollers 46, and further, the recording sheet is fed to a nip portion between the intermediate transfer belt 31 and a second transfer roller 35, where the toner image (a color composite image) is transferred to the recording sheet (second transfer). Thereafter, the recording sheet is fed to a fixing unit 47 and is subjected to a heat treatment, so that the toner is fixed on the recording sheet. Then, the sheet is ejected onto a tray (not shown) disposed on an upper surface of the apparatus body via a pair of ejection rollers 48.

In an operation for double-side printing, after a first side of a sheet is subjected to printing and toner fixing, the sheet is fed back with reverse rotation of the ejection rollers 48 and fed downward in a reversing sheet path 50. Then, the sheet is fed to the pair of timing rollers 46 again, and a second side of the sheet is subjected to printing and toner fixing. Thereafter, the sheet is ejected through the pair of ejection rollers 48. Also, it is possible that sheets placed on a tray 52 in a manual feed section 51 are fed to the timing rollers 46 one by one.

Figure 2:
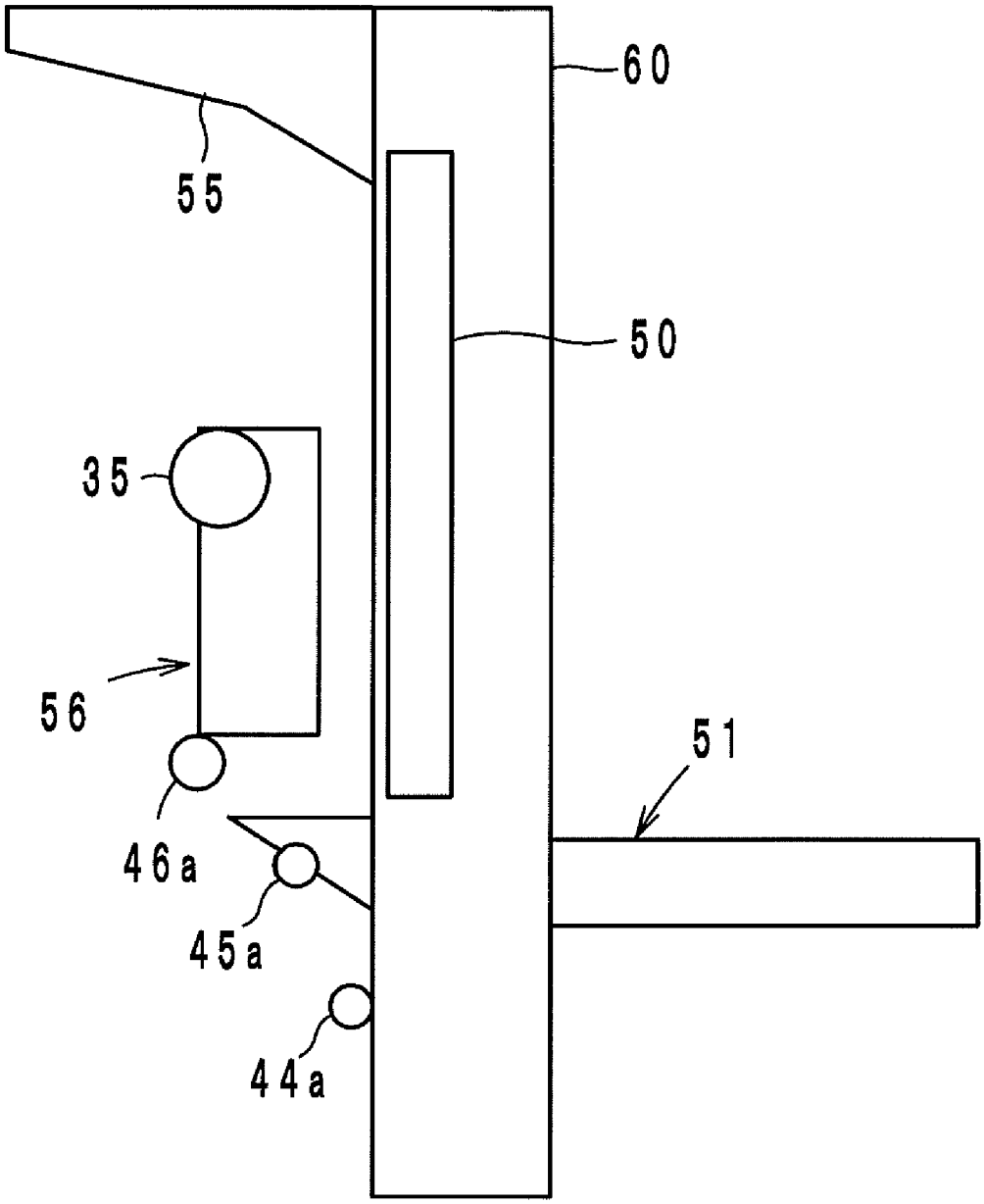
FIG. 2 is a schematic view of a door provided for the printer on a side surface of a printer body.

A relatively large door 60 is disposed on a side surface of the apparatus body such that the door 60 pivots open and closed on a rear side (rear side of the paper surface of FIG. 1). As shown by FIG. 2, the door 60 incorporates the reversing sheet path 50, a guide plate for reverse feeding 55, a vertical feed unit 56 comprising the second transfer roller 35 and one 46*a* of the pair of timing rollers 46, one 44*a* of the pair of feed-out rollers 44, one 45*a* of the pair of feed-out rollers 45 and the manual feed section 51.

In the rear side of the apparatus body, brackets 71, 72 and 73 are fixed to the apparatus body, and by inserting pins 61, 62 and 63 vertically in holes made in the brackets 71, 72 and 73 respectively, the door 60 is supported to be capable of pivoting horizontally on the pins 61, 62 and 63. The brackets 71, 72 and 73 and the pins 61, 62 and 63 are disposed in an upper portion, in a middle portion and a lower portion of the door 60. Screws (not shown) are inserted in fastening holes 71*a*, 72*a* and 73*a* of the brackets 71, 72 and 73 and are tightened onto the apparatus body, so that the brackets 71, 72 and 73 are fixed on the apparatus body.

The fastening hole 72*a* of the middle bracket 72 is a circular hole, and the middle bracket 72 is fixed in a specified position relative to the apparatus body. The fastening holes 71*a* and 73*a* of the upper and the lower brackets 71 and 73 are elongate holes elongating in the horizontal direction, and the brackets 71 and 73 are fixed in positions adjustable relative to the apparatus body. A positioning pin 64 is disposed to stand on the door 60 in the front side, and the positioning pin 64 is inserted in a reference hole (not shown) of the apparatus body.

First, the pin 62 is inserted in the hole of the middle bracket 72, and the positioning pin 64 is inserted in the reference hole (not shown). Thereby, the door 60 is positioned to be parallel to the apparatus body. At this stage, the upper and the lower brackets 71 and 73 are temporarily fastened to the apparatus body and are adjustable within the ranges of the elongate holes 71*a* and 73*a*. After the positioning of the door 60 relative to the apparatus body by use of the bracket 72 and the positioning pin 64, the brackets 71 and 73 are screwed down through the holes 71*a* and 73*a*. In this way, the door 60 is fixed to the apparatus body in such a way to be capable of pivoting.

In this embodiment, this structure brings the following advantages. Since three supports, namely, the upper bracket 71, the middle bracket 72 and the lower bracket 73 are disposed for the horizontal pivot of the door 60, even if the door 60 is large, it is possible to fasten the door 60 to the apparatus body with distortion inhibited. Further, since the upper support and the lower support are adjusted in reference to the middle support, the accuracy of positioning of the door 60 is improved.

Components of the sheet paths, that is, the reversing sheet path 50, a guide member 55 for sheet reversing, the vertical feed unit 56 comprising the second transfer roller 35 and the roller 46*a*, the rollers 44*a* and 45*a*, and the manual feed section 51 are in the accurately positioned door 60. Therefore, the accuracy of positioning of these components is greatly heightened compared with a case wherein these components are disposed in different doors, and the sheet feeding performance is improved. Also, only the door 60 must be opened for treatment of a paper jam, which is less troublesome than a case wherein a plurality of doors must be opened, and the handleability for treatment of a paper jam is good.

Figure 3:
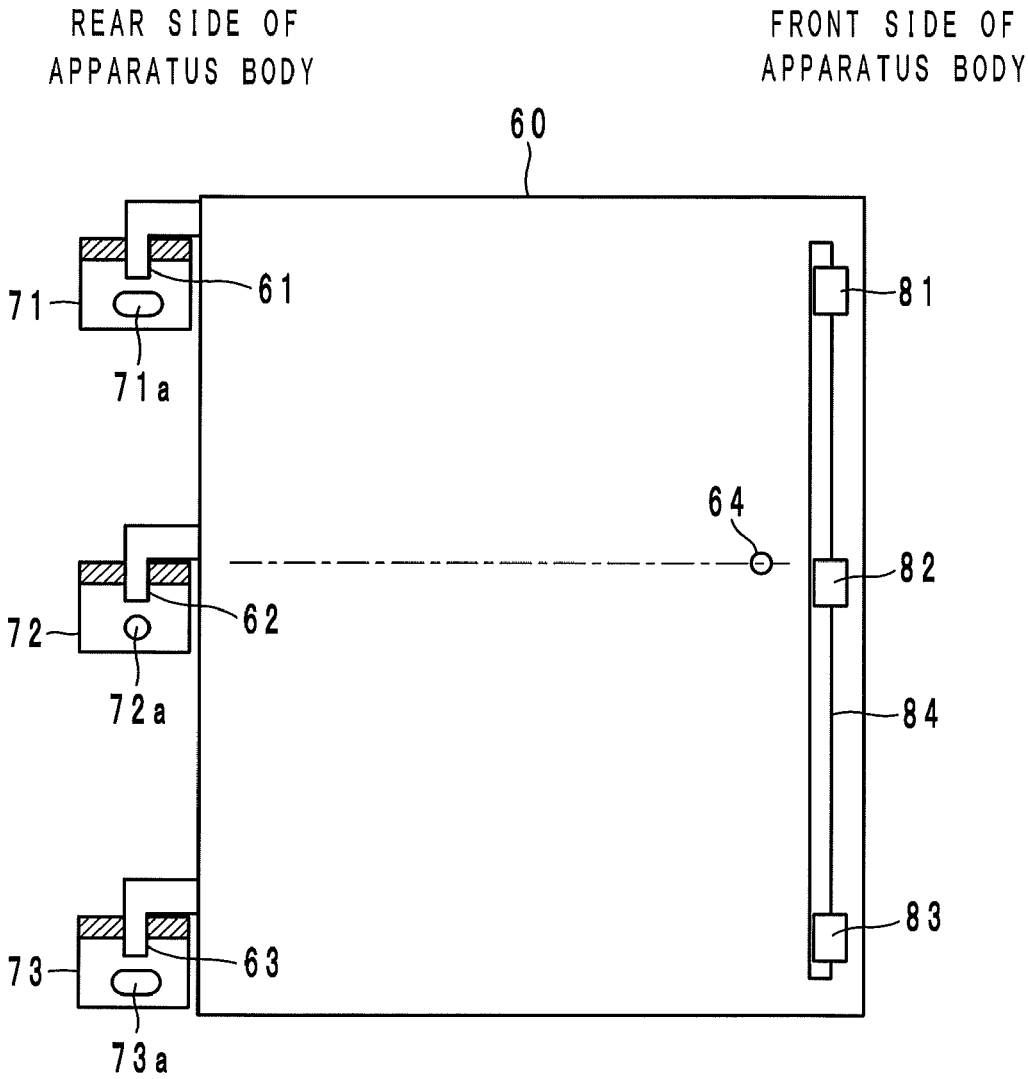
FIG. 3 is a schematic view of the door, viewed from the inside of the printer body.

Next, the lock mechanism for the door 60 is described. As shown by FIG. 3, at the front side of the apparatus body, three pairs of a locking claw and a locking hook are provided at three points. Specifically, a pair of a locking claw 81 and a locking hook 85, another pair of a locking claw 82 and a locking hook 85 and another pair of a locking claw 83 and a locking hook 85 (see FIG. 4) are provided in an upper section, a middle section and a lower section, respectively. The locking claws 81, 82 and 83 are fixed to a lock shaft 84 that is supported by the door 60 to freely rotate. The locking hooks 85 are fixed to the apparatus body.

Figure 4:
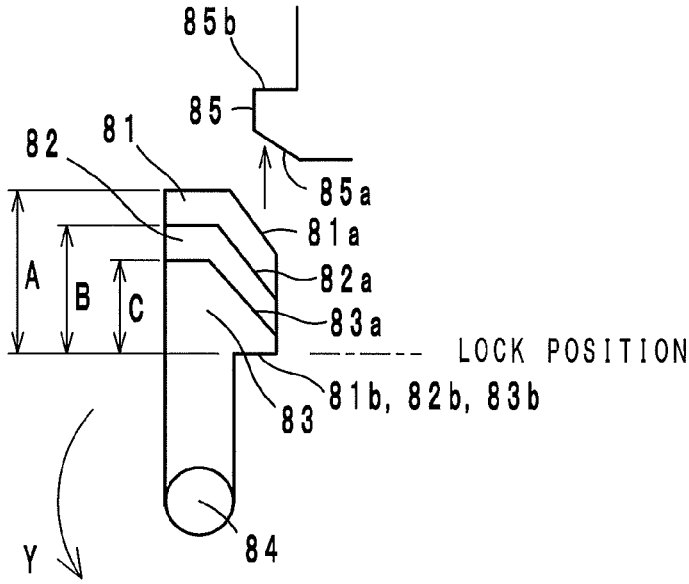
FIG. 4 is an illustration showing the positional relationship between locking claws and locking hooks.

When the door 60 is closed, as shown by FIG. 4, inclined surfaces 81*a*, 82*a* and 83*a* of the locking claws 81, 82 and 83 hit on inclined surfaces 85*a* of the locking hooks 85, whereby the lock shaft 84 and the locking claws 81, 82 and 83 rotate in a direction "Y", and then, steps 81*b*, 82*b* and 82*c* of the locking claws 81, 82 and 83 come into engagement with steps 85*b* of the claw members 85. In this way, the door 60 is locked. The lock shaft 84 is pressed in a direction opposite to the direction "Y" by a spring (not shown). When the lock shaft 84 is rotated in the direction "Y" against the spring force, the door 60 is unlocked.

Figure 5:
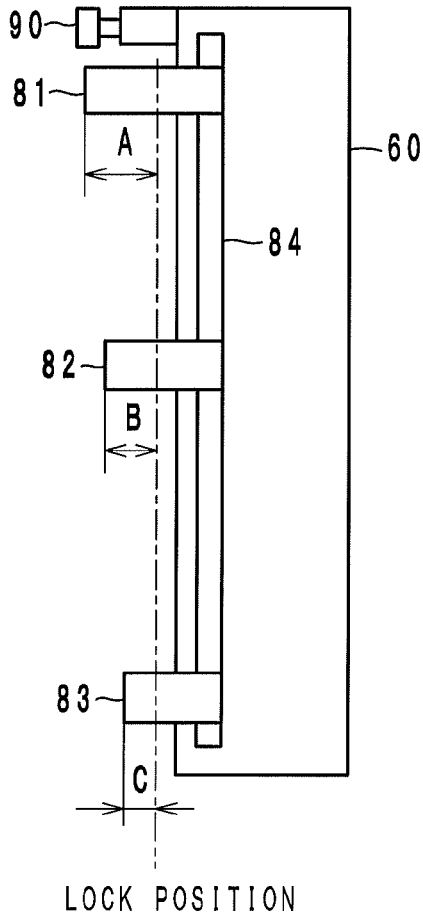
FIG. 5 is an illustration showing the projecting amounts of the locking claws.

The locking claws 81, 82 and 83 have mutually different shapes. Specifically, the angles of the inclined surfaces 81*a*, 82*a* and 83*a* are slightly different from one another. Moreover, as shown by FIGS. 4 and 5, the locking claws 81, 82 and 83 have projecting amounts A, B and C, respectively, from the lock position that meet the condition of A>B>C.

As described above, at the front side of the apparatus body, three pairs of a locking claw and a locking hook for locking the door 60 are provided in three points, that is, in an upper section, in a middle section and in a lower section. Thereby, distortion and deformation of the large door 60 can be inhibited, and secure locking of the door 60 is possible. More specifically, when the door 60 is closed, the door 60 receives reactive force from rollers and other members at a plurality of points. With the locking mechanism, however, the door 60 is locked at the upper section, at the middle section and at the lower section, and the reactive force is offset at a plurality of points. Thereby, distortion and deformation of the door 60 is inhibited.

The locking claws 81, 82 and 83 have different shapes and especially have different projecting amounts A, B and C from the lock position. Accordingly, when the door 60 is put closed, the locking claws 81, 82 and 83 hit on the locking hooks 85 at different times, and it never happens that the door 60 receives reactive force at a plurality of points concurrently. Thereby, deformation of the door 60 is inhibited.

Next, a mechanism for detecting an open/closed state of the door 60 is descried. As shown in FIG. 5, a sensor 90 for detecting the door 60 closed is provided. The sensor 90 is disposed at a position to face the upper side of the door 60. The sensor 90 may be of a contact type using an actuator or of a non-contact type using optical elements, as long as it senses the opening/closing motion of the door 60 and detects the open/closed state of the door 60.

The projecting amounts A, B and C of the locking claws 81, 82 and 83 are set such that the nearer to the sensor 90 the locking claw is, the larger the projecting amount is. When the door 60 is put closed, the locking claw 81 that is the nearest to the sensor 90 and that has the largest projecting amount hits against the locking hook 85 first. Thereby, the locking claw 81 pivots, and concurrently the other locking claws 82 and 83 fixed to the lock shaft 84 pivot together. If a user pushes the door 60 on the lower section to close the door 60, the lower locking claw 83 will be hooked on the lower locking hook 85, but the upper locking claw 81 may fail to engage with the upper locking hook 85 due to bending of the door 60. On the other hand, if a user pushes the door 60 on the upper section to close the door 60, the upper locking claw 81 hits against the upper locking hook 85 first, and the upper locking claw 81 and the other locking claws 82 and 83 pivot together before the locking claws 82 and 83 hit against the corresponding locking hooks 85. Thereby, the locking claws 81, 82 and 83 are hooked on the locking hooks 85. In this embodiment, since the sensor 90 is disposed near the locking claw 81 with the largest projecting amount, the sensor 90 makes no mistake in detecting the open/closed state of the large door 60.

The sensor 90 may be disposed in a position to face the lower side of the door 60. In this case, the projecting amounts of the locking claws 81, 82 and 83 are set such that the lower the locking claw is positioned, the larger the projecting amount is.

Other Embodiments

The detailed structure of the door, the kinds of components fitted to the door, the details of the lock mechanism and the details of the open/closed state detection mechanism may be designed arbitrarily.

Although the present invention has been described in connection with the preferred embodiment above, it is to be noted that various changes and modifications are possible to those who are skilled in the art. Such changes and modifications are to be understood as being within the scope of the present invention.

What is claimed is:

1. An image forming apparatus comprising:

a door provided on a side surface of a body of the image forming apparatus; and three pivot points for supporting the door to be capable of pivoting horizontally, the pivot points being disposed in a rear side of the body of the image forming apparatus, in an upper section, in a middle section and in a lower section, respectively, wherein the pivot points in the upper section and in the lower section are adjustable with reference to the pivot point in the middle section.

2. An image forming apparatus according to claim 1, wherein a component of a sheet path is incorporated in the door.

3. An image forming apparatus according to claim 1, further comprising three pairs of a locking claw and a locking hook for locking the door in a closed position, the three pairs of a locking claw and a locking hook being disposed in an upper section, in a middle section and in a lower section, respectively.

4. An image forming apparatus according to claim 3, wherein the three locking claws have mutually different shapes.

5. An image forming apparatus according to claim 3, further comprising a detector for detecting the door in a closed state, the detector being disposed in a position to face an upper side or a lower side of the door, wherein:

the locking claws are fixed to a shaft; and the nearer to the detector the locking claw is, the larger projecting amount toward the corresponding locking hook the locking claw has.

* * * * *